United States Patent [19]

Sommer et al.

[11] Patent Number: 4,713,655

[45] Date of Patent: Dec. 15, 1987

[54] METHOD OF MONITORING THE QUALITY OF A PACKAGE OF THREAD

[75] Inventors: Hans-Jorg Sommer, Zurich; Heinz Mutter, Winterthur; Armin Wirz, Ossingen; Felix Graf, Winterthur, all of Switzerland

[73] Assignee: Rieter Machine Works, Ltd., Winterthur, Switzerland

[21] Appl. No.: 745,885

[22] Filed: Jun. 18, 1985

[51] Int. Cl.[4] ..... G08B 21/00

[52] U.S. Cl. ..... 340/677; 28/187; 66/163; 73/160

[58] Field of Search ..... 340/677; 66/163; 57/81; 28/187, 228, 289; 73/160; 242/36

[56] References Cited

U.S. PATENT DOCUMENTS 3,902,364 9/1975 Craig et al. ..... 73/160
4,060,965 12/1977 Schwartz ..... 340/677

FOREIGN PATENT DOCUMENTS 58-67848 9/1983 Japan .

*Primary Examiner*—Glen R. Swann, III
*Attorney, Agent, or Firm*—Kenyon & Kenyon

[57] ABSTRACT

Logic signals corresponding to a detected thread break and/or thread loop in a package being wound on a bobbin are evaluated within a logic circuit to communicate the quality of a thread package. The logic signals can be processed in various ways.

In one embodiment, discrimination is made of repeated logic signals produced by a single thread break.

In another embodiment, the total number of logic signals are counted.

Blocking arrangements can be provided to block logic signals caused by the same thread break or thread loop.

12 Claims, 16 Drawing Figures

Fig. 3
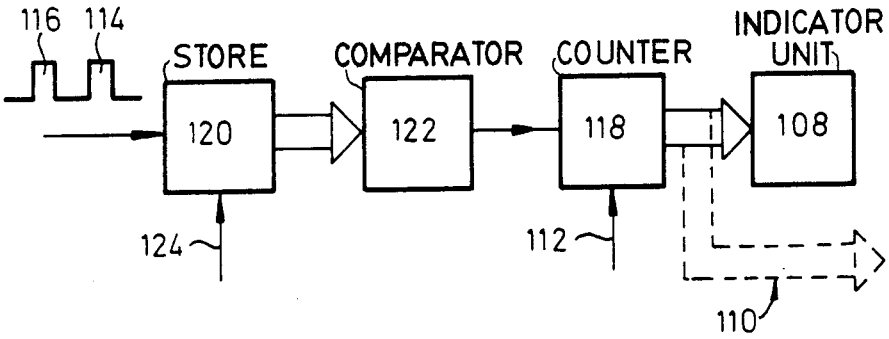
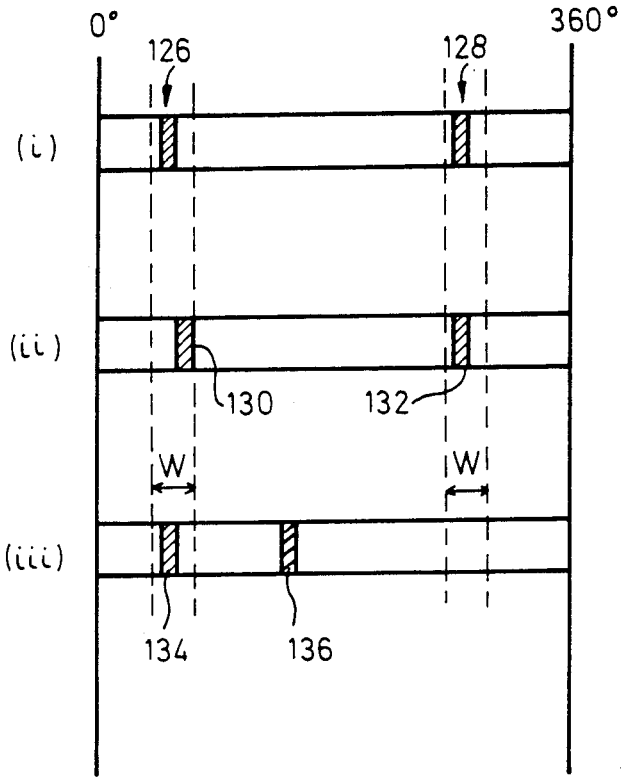
Fig. 3A

METHOD OF MONITORING THE QUALITY OF A PACKAGE OF THREAD

BACKGROUND OF THE INVENTION

This invention relates to a method of monitoring the quality of a package of thread. More particularly, this invention relates to a method of monitoring a thread package, being wound on a bobbin.

As is known, when a thread is being wound into a package the degree of compactness of the thread can be effected by thread breaks or by the formation of thread "loops", for example as described in U.S. Pat. No. 4,677,387. Accordingly, as described in this prior patent, a method has been provided of monitoring the degree of compactness of a thread or a body of thread by sensing a projection of thread from a predetermined curved path at a sensing position maintained at a predetermined spacing from a path. As also described, devices have been provided for monitoring the degree of compactness by using a sensing means which is responsive to the presence of a thread at a predetermined location, for example, at a predetermined spacing from the thread package being wound on a bobbin, as well as mounting means for maintaining the sensing means at a predetermined spacing from the thread package.

SUMMARY OF THE INVENTION

It is an object of this invention to provide a relatively simple method of monitoring the quality of a thread package during package formation.

It is another object of the invention to provide for a relatively simply logic processing of signals for the monitoring of the quality of a thread package.

Briefly, the invention provides a method of monitoring the quality of a package of thread during package formation which includes the steps of passing a thread through a predetermined thread path to form a thread package and sensing a projection of thread beyond the predetermined path at a sensing location maintained at a predetermined spacing from the path. In accordance with the invention, an output signal is produced in response to each sensing of a projection of thread at the sensing location with each output signal being processed to produce a corresponding logic signal. In addition, the logic signals are subjected to logic processing during formation of a package of thread in order to provide an indication of the quality of the thread package as represented by the degree of compactness of the thread in the package or of the package structure.

Various devices may be employed to carry out the monitoring technique of the invention. For example, in one embodiment, an evaluation means may be adapted to count the logic signals which are produced as an indication of the quality of the package of thread.

In another embodiment, counting of a sequential series of logic signals may be carried out while preventing the counting of a logic signal produced during a controllable interval after a preceeding logic signal has been counted. In this embodiment, the repeated sensing of a thread break can be avoided.

In still another embodiment, the logic processing may include the steps of recording the stage of rotation of a body of thread at which a logic signal is produced and of comparing the record with logic signals received during a succeeding rotation to determine whether a logic signal is received at the same or substantially the same stage of the next rotation.

In still another embodiment, the logic processing may include the step of examining a sequence of logic signals for bursts of relatively high repetition frequency. This embodiment is particularly useful in detecting the presence of thread loops in a yarn package.

BRIEF DESCRIPTION OF THE DRAWINGS

These and other objects and advantages of the invention will become more apparent from the following detailed description taken in conjunction with the accompanying drawings wherein:

FIG. 3 illustrates a logic circuit in accordance with the invention for processing logic signals corresponding to individual filament breaks.

FIG. 3A graphically illustrates a technique for comparing received logic signals in the circuit of FIG. 3;

FIG. 7B graphically illustrates an output signal produced by a converter in the circuit of FIG. 7A;

FIG. 7C graphically illustrates an output signal of a differentiator of the circuit of FIG. 7A;

DESCRIPTION OF THE PREFERRED EMBODIMENTS

The logic circuits which are described herein can be used with the monitoring devices as described in U.S. Pat. No. 4,677,387. Accordingly, the full disclosure of the prior application is hereby incorporated by reference.

Figure 1:
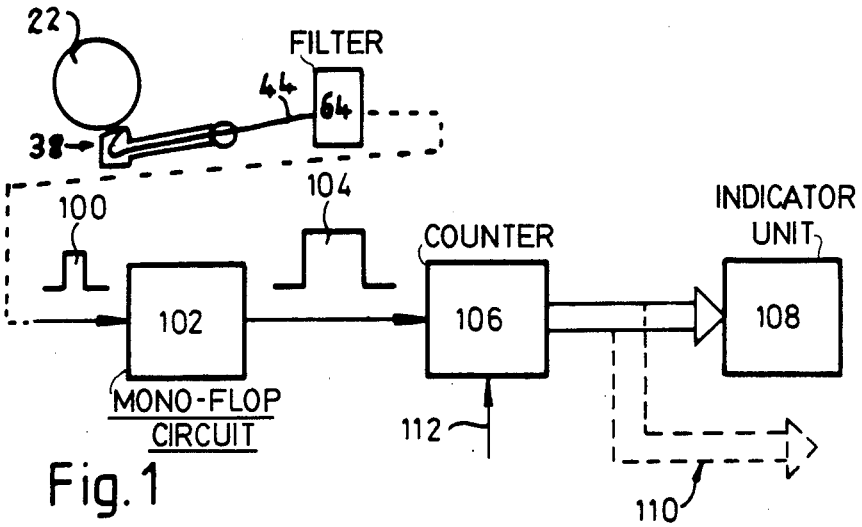
FIG. 1 diagrammatically illustrates a logic circuit for logic processing a logic signal in accordance with the invention.
Figure 2:
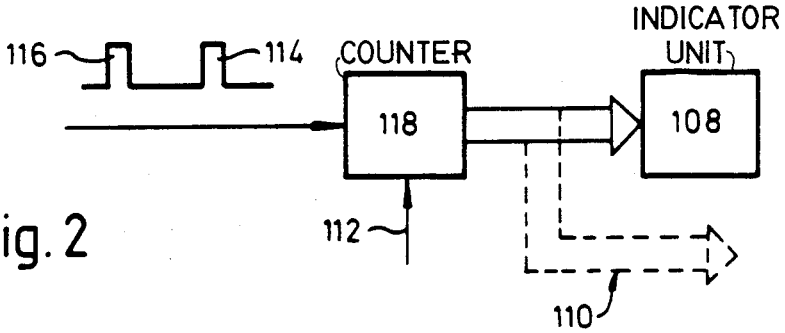
FIG. 2 illustrates a modified logic circuit in accordance with the invention.

The various logic circuits described in the following cooperate with a monitoring means and evaluating device as illustrated in FIGS. 2 and 3 of pending application Ser. No. 570,203, and indicated schematically in FIG. 1 of this application. As described in the previous application, an output signal on line 44 from detector head 38 is filtered at 64 to extract a signal which is recognizable as indicating the contact of a thread from package 22 with a charge collector in the detector head.

As a first step in accordance with the present invention, the filtered output signal produced by the arrangement as shown in FIG. 3 of the prior application is processed to give a logic signal for each detected contact of thread with the charge collector previously referred to. In the following description it will be assumed that this logic signal is in the form of a positive, rectangular pulse of predetermined amplitude and duration. Suitable circuitry for producing such predetermined logic outputs comprise a Schmitt-trigger followed by a so-called monoflop element. These elements are well-known and will not be illustrated or described in this application. Details of such circuitry, if required, can be found from the book "Halbleiter-Schaltungstechnik" by U. Tietze and Ch. Schenk, 5th Edition at pages 133–135.

It will be noted that the above description refers to each "detected" contact of thread with the charge collector. The processing circuitry prior to the issue of the logic signal will have a certain definable "discrimination" ability. Thus, if two filaments break virtually simultaneously or so that their broken ends lie at similar angular positions on the periphery of the package, then their broken ends will contact the charge collector virtually simultaneously and the processing circuitry will be unable to distinguish them. Only a single logic signal will produced. This "discrimination" ability of the processing circuitry must be determined in accordance with the resulting costs (finer discrimination will be accompanied inevitably by higher costs) and the benefits obtained from such discrimination, in particular bearing in mind the probability of substantially simultaneous breaks or other substantially simultaneous "events" to be detected.

The following description will deal with the processing of the logic signals. It is not directed to the discriminating circuitry or to the logic signal generators responding thereto.

The evaluation system shown in FIG. 1 is designated to count broken filaments only. Quite apart from the question of the discrimination ability of the processing circuitry, the principle underlying the system shown in FIG. 1 is based on the assumption that substantially simultaneous filament breakages are very rare occurrences, and can be ignored in practical terms. The assumption is that after one filament breakage has been detected, in the vast majority of instances, a substantial time will elapse before a further filament breakage occurs. The system is therefore designed to respond to the first contact of a broken filament end with the charge collector (not shown) and then to "block" so as to ignore any further detected contacts over a predetermined time interval. The system thus ignores any repeated contacts of the first broken filament end and, of course, any further broken filaments which might happen to occur in the defined time interval. The required time interval is determined empirically so that repeat contacts of the first broken filament end will have died away before the expiry of the defined time interval and so that no significant loss of information occurs due to substantial numbers of additional filament breakages during the "block" time.

In FIG. 1, a logical signal 100 which is produced by the processing circuitry (not shown) to indicate the first contact of a given broken filament with the charge collector (not shown) is fed to a mono-flop (or monostable) circuit 102. This circuit 102 has two possible states, in only one of which it is stable. The arrival of signal 100 at the input to the circuit 102 forces this circuit 102 into its unstable condition in which it can remain for only a predetermined time interval dependent upon the design of the circuit. Upon this initial change of state, the output of circuit 102 changes condition (e.g. low to high as indicated by the output signal 104) and the output returns to the original condition at the expiry of the predetermined time interval. Details of such monoflop circuits can be found for example from page 133 of the above noted Tietze/Schenk textbook.

The output of circuit 102 is connected as an input to the counter 106 which is adapted to respond to the changes of state of the mono-flop. The counter 106 could, for example, increment one unit for each positive going pulse received on its input from circuit 102. The output of counter 106 can be fed to an indicator unit 108 and/or a data processing means (not shown) for example on a data bus 110. The counter 106 also has an input 112 to receive a reset signal from the winder control system such that the counter 106 is reset to 0 at the start of each fresh winding operation.

During the predetermined time interval represented by the elongated pulse 104, mono-flop circuit 102 cannot respond to any further logic signals 100 at its input. Accordingly, repeated contacts of the first broken filament with the charge collector (not shown) within this predetermined time interval will have no effect upon the count in counter 106; a second or further broken filament occurring within the same interval will also be blocked from "access" to the counter 106.

Referring to FIG. 2, wherein like references characters indicate like parts as above, the logic circuit may be based upon a radically different design principle from the circuit of FIG. 1. In this regard, the logic circuit evaluation system is also constructed to respond only to broken filaments but assumes that filament breakages are liable to happen within a short interval from each other and that the system should respond to as many such breakages as possible. The response of the system to breakages is therefore limited only by the discrimination ability of the processing circuitry as already referred to above. Each detected contact of filament with a charge collector (not shown) produces a logic signal, two of which have been indicated at 114 and 116 respectively, and each such logic signal is registered in the counter 118. The indicator 108, the data bus 110 and the reset input 112 perform functions identical to those of the corresponding elements shown in FIG. 1.

The systems shown in FIG. 2 will respond not only to each detectable (discriminable) filament breakage but to each contact of a given broken filament with the charge collector. The system is therefore most appropriate where some kind of statistical averaging process occurs so that either each filament breakage produces substantially the same number of contacts with the charge collector, or the number of contacts varies in some statistically predictable fashion, for example around a predictable average number of contacts per break.

Referring to FIG. 3, wherein like reference characters indicate like parts as above, the evaluation system may be constructed to detect as many individual filament breakages as possible, but without relying upon a statistical averaging process to interpret the logic output signals. To this end, the system also employs a store 120 and a comparator 122, the purpose of which will now be described.

The store 120 is of the type having a plurality of storage cells which can be addressed cyclically and sequentially. The cells are organized into groups, each group comprising a predetermined number of cells, the number being the same for each group. Each group of cells represents one full rotation of the package being formed, and the individual groups represent successive rotations. For example, there may be three such groups representing three successive rotations of the package as indicated in FIG. 3A by the numerals (i), (ii) and (iii). Within each group, each individual cell represents a predetermined angle of rotation of the package, and all the cells of the group taken together represent 360° of package rotation. If, for example, each group comprises 120 cells, then each cell represents 3° of package rotation. Since the cells are addressable sequentially, each cell represents a predetermined, identifiable interval within one rotation of the package. The individual cells have not been indicated on the horizontal bar diagrams in FIG. 3A, but the beginning and end of one package rotation is represented by the vertical lines marked with 0° and 360° respectively.

A phase lock system is provided so that addressing of the cells in store 120 is dependent upon a phasing signal on an input 124 to the store 120, the phasing signal in turn being dependent upon the package rotation. For example, there could be phasing marks associated with the chuck upon which a package is wound and producing phasing signals fed to the input 124 in order to control the addressing of the storage cells.

If now a first filament breakage occurs at a predetermined stage in rotation (i), then the corresponding logic signal is stored in the cell of group (i) corresponding to this stage. This is indicated by the mark 126 in the horizontal bar diagram (i) in FIG. 3A. If a second, detectable filament breakage occurs at a later state in rotation (i), the the corresponding logic signal is stored in another, appropriate cell of group (i), as indicated by the mark 128 in FIG. 3A. It is assumed that no further filament breakages occur during rotation (i).

During rotation (ii), the broken filament ends produced by the first and second filament breakages produce respective repeat contacts with the charge collector so that signals are stored in respective, appropriate storage cells of group (ii). This is indicated by the marks 130 and 132 respectively in bar (ii) in FIG. 3A. Idealy, of course, the cells in group two will correspond exactly with those in group one. As will be described below, however, some allowance has to be made for "tolerances" in the processing system.

On rotation (iii), it is assumed that the first filament breakage still has a projecting filament end which produces a detectible contact with the charge collector so that a signal is stored in the appropriate cell of group (iii) as indicated at 134 in FIG. 3A. It is also assumed, however, that the broken filament end corresponding to the second filament breakage has already been wound into the package so that there is no repeat contact with the charge collector and no stored signal in group (iii) corresponding to signals 128 and 132. Instead, it is assumed that a third filament breakage has occurred in rotation (iii) at a stage of the rotation between the stages corresponding to the first and second filament breakages in rotations (i) and (ii), and a signal is stored in a corresponding cell of group (iii) as indicated by the mark 136 in FIG. 3A.

The phasing signals are also fed to a read-out system (not shown—for example part of a suitable microprocessor) so that after each rotation the contents of the corresponding storage cells are read-out as a "rotation record" to the comparator 122 and are compared with the contents of the cells (the rotation record) for the preceding rotation. Assume that in the case of rotation (i) the comparator has no previous "record" of a filament breakage. Each of the stored signals 126 and 128 will be interpreted as a new breakage and, corresponding count signals will be fed to the counter 118. After rotation (ii), comparator 122 will be able to compare with the record for rotation (i). If, for example, comparator 122 finds that a signal 126 is stored in cell "d" of group (i) and a signal 130 is stored in cell "d" of group (ii) or in a cell within a predetermined band of width W centered on cell "d" of group (ii), then the comparator 122 decides that signal 130 originates from the same filament breakage as signal 126 and no increment signal is passed to counter 118. Similarly, if signal 134 is found within the band W based on cell "d" in group (iii), then no increment signal is passed to counter 118, since signal 134 is also considered to originate from the first filament breakage.

Similarly, if signal 128 is found in cell "r" of group (i), and signal 132 is found in a cell within the same band W of cell "r" of group (ii), then the comparator 122 does not issue an increment signal in response to signal 132 because the latter is assumed to originate from the second filament breakage which has already been recorded in response to detection of signal 128 as described above.

In group (iii ), however, signal 136 is found in a cell outside both the "d" band and the "r" band and the comparator 122 therefore passes an increment signal to the counter 118 to record detection of a third filament breakage. In group (iii), no signal is detected in the "r" band. The detection of a signal within this band and a later group will therefore be interpreted as the occurrence of a new filament breakage and a corresponding increment signal will be passed to the counter by the comparator.

The record of a given group (or rotation) is compared only with the record of the immediately preceding group (or rotation). Accordingly, the record of rotation (iv) can be entered into the cells of group (i), and can then be compared with the record stored in group (iii). However, the storage system described above is not essential and has been mentioned only because it happens to correspond with the illustrative diagram given in FIG. 3A. There might, for example, be permanent storage for only a single "group" (i.e. one rotation). Incoming signals of the next "group" (rotation) could be compared immediately with those stored for the previous group (rotation). Increment signals for the counter could be issued when appropriate differences are detected and the "ongoing record" could be updated in the store.

Figure 4A:
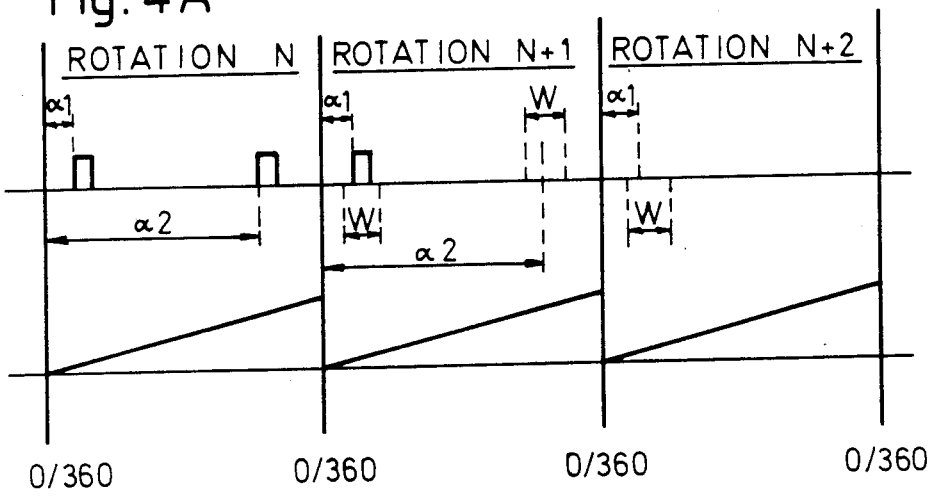
FIG. 4A graphically represents a further evaluation principle in accordance with the invention.
Figure 4B:
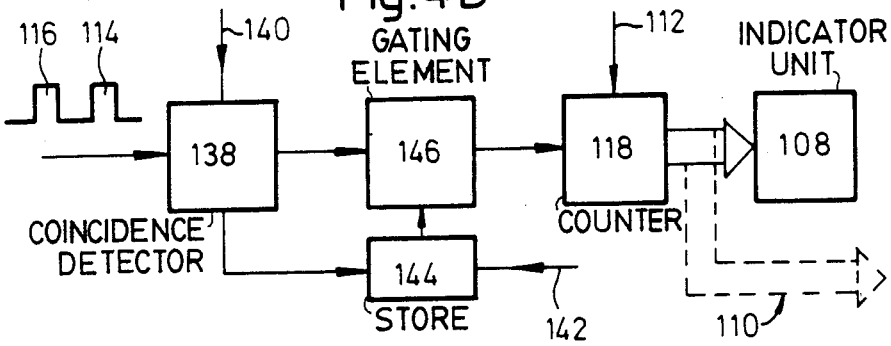
FIG. 4B illustrates a logic circuit employing the principle graphically illustrated in FIG. 4A.
Figure 4C:
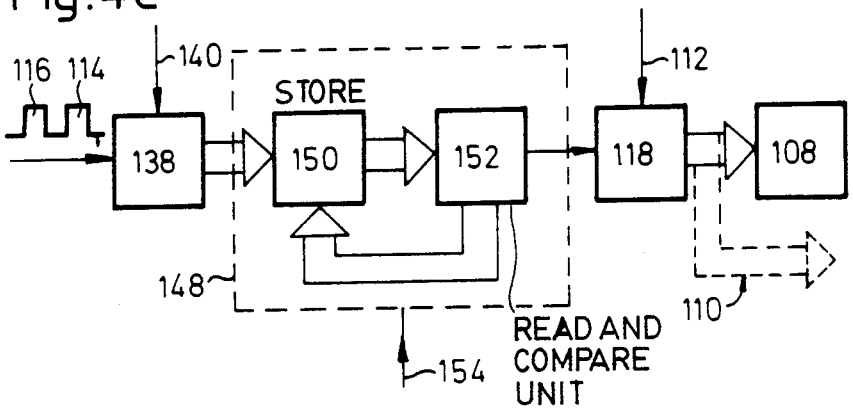
FIG. 4C illustrates a modified logic circuit employing the principle graphically illustrated in FIG. 4A.

Referring to FIG. 4A, 4B and 4C, an evaluation system may also be constructed to perform essentially the same function as the system shown in FIG. 3 while avoiding the need to store a complete record of each revolution. To this end, the system is adapted to respond to filament breakages only, and operates upon the principle of detecting the rotation angle of the package (starting from some arbitrary reference) at which a filament breakage is first detected and ignoring detection of a filament breakage at the same or substantially the same package rotation angle in subsequent rotations of the package until after the original filament breakage has ceased to be detected. In each of FIGS. 4B and 4C, the elements 108, 110, 112 and 118 correspond with similarly referenced elements in the preceding figures, and will not be described again.

Referring to FIG. 4B, the system includes a coincidence detector 138 which is adapted to receive the logic signals 114, 116 etc. on one input and a signal representative of the instantaneous package rotation angle on a second input 140. The signal appearing on input 140 is a cyclically varying signal; the instantaneous condition of which is characteristic of the instantaneous rotation angle of the package. For example, this signal may take a saw-tooth form as shown in the lower portion of FIG. 4A, or (more conveniently) a digitized version of that saw-tooth form.

When the coincidence detector 138 receives a logic signal, for example signal 114 or 116, the detector 138 provides an output to a store 144 representative of the package rotation angle at which the logic signal was detected, for example angle 1 in the upper portion of FIG. 4A. The detector 138 simultaneously issued an "increment" signal to a gating element 146. If gating element 146 is not blocked by the control element 144, it will pass the increment signal to a counter 118 so that a filament breakage will be recorded. If the gate 146 is blocked by the control element 144, then the increment signal will be extinguished so that the count in the counter 118 will not be changed.

The control element 144 also has an input 142 to receive the signal representing the package rotation angle. On the basis of the cyclically varying signal it receives on input 142 and "coincidence" signals received from the detector 138, the control element 144 defines "block" or "release" conditions for the gate 146.

In the absence of any stored coincidence signal in the control element 144, that element will condition the gate 146 to pass any increment signals received from the detector 138. If, therefore, the first filament breakage occurs in rotation N (see FIG. 4A) at package rotation angle $\alpha 1$, then the appropriate increment signal will be passed by the gate 146 and registered in the counter 118. However, during rotation N+1, the element 144 will condition the gate 146 to block during a "window" of width W around the package rotation angle $\alpha 1$. If another coincidence signal is issued during this block window, the gate 146 will prevent passage of the associated increment signal to the counter 118, and the control element 144 will define a similar blocking window around the angle $\alpha 1$ in rotation N+2.

If another coincidence signal is issued at angle $\alpha 2$ in rotation N, then an associated increment signal will also be passed by the gate 146 to the counter 118. The control element 144 will also define a block window W around the rotation angle $\alpha 2$ in rotation N+1. However, if no coincidence signal is issued during this block window, there will of course be no necessity for the gate 146 to block an increment signal therefor, and the $\alpha 2$ record in the control element 144 will be extinguished so that no block window will be defined around rotation angle $\alpha 2$ in rotation N+2.

FIG. 4C shows an alternative arrangement which also relies upon detection of the package rotation angle at which a filament breakage occurs but which does not use blocking windows. The coincidence detector 138 in FIG. 4C is similar to that in FIG. 4B, but in this case, the detector 138 simply issues a coincidence signal indicating the package rotation angle at which a logic signal 114 or 116 is detected. This is passed to a unit 148 indicated in dotted lines and comprising a store 150 and a read and compare unit 152. The unit 148 also receives on an input 154 the cyclically varying package rotation signal, so that it operates in synchronism with the package rotation.

Referring to FIGS. 4A and 4C, a coincidence signal will be stored in store 150 indicating occurrence of a filament breakage at package rotation angle $\alpha 1$ during rotation N. Read and compare unit 152 will find no record of a previous filament breakage at this package rotation angle, and will issue an increment signal to the counter 118. A similar increment signal will be passed to the counter in response to the coincidence signal stored in store 150 at package rotation angle $\alpha 2$ during rotation N.

During rotation N+1 read and compare unit 152 will find an already existing record in store 150 corresoonding to the coincidence signal at package rotation angle $\alpha 1$ (or within a predetermined tolerance band around angle $\alpha 1$) and no further increment signal will be issued. The record for angle $\alpha 1$ will, however, be retained in store 150 and this retained record will prevent issue of an increment signal for a coincidence detected at angle $\alpha 1$ in rotation N+2.

If, however, as assumed above, no coincidence is detected at rotation angle $\alpha 2$ in rotation N+1, the read and compare unit 152 will extinguish the appropriate record from the store 150. The coincidence occurring at package rotation angle $\alpha 2$ will therefore be detected as a filament breakage and an appropriate increment signal will be passed to the counter 118.

The counter 118 delivers data which can be used in a variety of different ways. One simple use could involve manual recording during a doffing operation of the "fault count" for each package noted on the indicator 108 referred to above. The information could, for example, be recorded upon a ticket attached to the relevant package and giving a simple indication of the "quality" thereof. The data can, however, be processed in a more complex fashion. For example, it can be passed via a bus 110 to a data processing system, together with signals indicating (for example) the winding machine, package number, data, operating shift and any other relevant information desired by the machine user. The resulting statistical data can provide a useful basis for fault analysis both for the individual package, for the winding machine over time and for the preceding system such as the spinning and/or drawing equipment.

Figure 5:
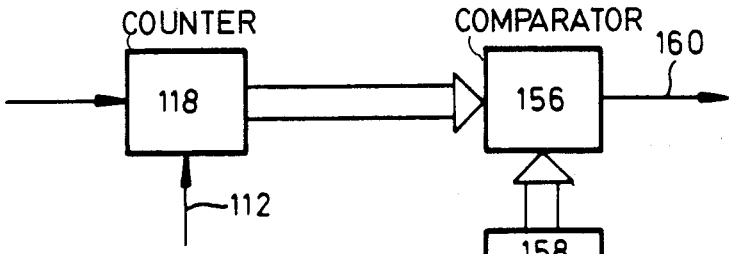
FIG. 5 illustrates a logic circuit for emitting an alarm in dependence upon received logic signals in accordance with the invention.

Referring to FIG. 5, the counter 118 may also be used to effect an alarm. For example, the current state of the counter 118 is continuously fed to a comparator 156 for comparison with a set value 158. If the accumulated count in the counter 118 exceeds the set value, then the comparator 156 issues a signal on an output 160. This signal can be a simple alarm to draw the attention of the operating personnel, or it could be a stop signal closing down the associated winding equipment.

The embodiments described with reference to FIGS. 1–4 inclusive have been concerned with detection and counting of individual filament breakages. The embodiments to be described with reference to the remaining figures are concerned with a slightly different phenomenon referred to in U.S. Pat. No. 4,677,387 as faulty package formation, for example due to faulty thread lay-down during the package build-up. In such a case, slippage of package layers may produce within a very short period a plurality of "loops" projecting from the package surface, each loop producing an individual signal when contacting the charge collector described in the prior application.

The essential difference between filament breakage and loop formation therefore relates to the frequency of the "events" which will be detected by the charge collector. Filament breakages should occur relatively infrequently with a relatively low number of detected "events" for each breakage. On the other hand, the package fault giving rise to "loops" will produce a "burst" consisting of a relatively large number of detected "events" in a very short period.

Figure 6:
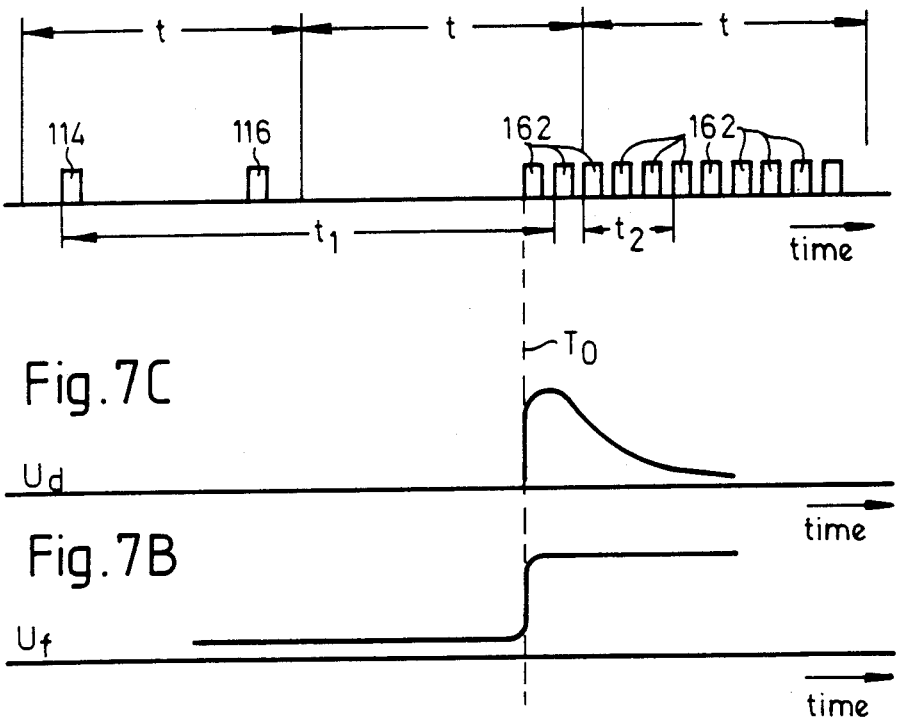
FIG. 6 graphically illustrates the occurrence of logic signals corresponding to filament breaks and loops occurring in a thread package.

This is represented diagrammatically in FIG. 6 in which logic signals 114 and 116 corresponding to filament breakages are shown on a horizontal time axis and logic signals 162 corresponding to a burst of loops are also shown on the same axis. The repetition frequency of signal 162 is clearly very much higher than that of signals 114, 116.

Figure 7A:
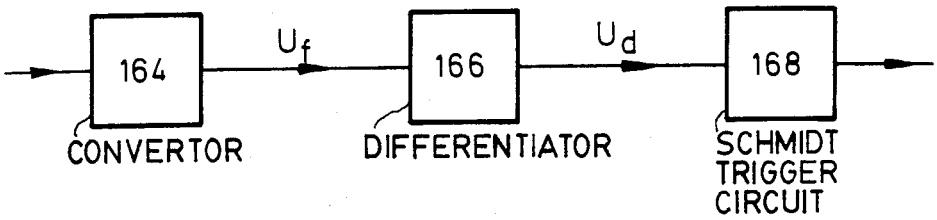
FIG. 7A illustrates a block diagram of a part of a logic circuit for processing logic signals occurring in a manner similar to that shown in FIG. 6.

Referring to FIG. 7A, the evaluation system is intended to respond to the repetition frequency of the logic signals 114, 116, 162. These signals are supplied as an input to a frequency/voltage converter 164 which supplies a DC outout signal UF (FIG. 7B) at a level dependent upon the repetition frequency of the incoming logic signals. From FIG. 7B, which is based on a different (more compressed) time scale compared with FIG. 6 it will be seen that the level of the output signal UF is relatively low up to the time T0 at which a "loop burst" occurs. And then there is a sudden steep rise in the output of converter 64.

The output of the converter 164 is fed to a differentiator 166 providing an output signal Ud shown in FIG. 7C. As shown, the differentiator 166 produces a pulse-like output in response to the steep rise in the level of Uf occurring at the time T0. The signal Ud is fed to a Schmidt trigger circuit 168 which will provide a pulse output of predetermined amplitude and duration once the input signal Ud exceeds a predetermined threshold level as in the case of the pulse-like signal at time T0. The output of the Schmidt trigger 168 can be recorded in a special counter for recording package-build faults. This counter can be similar to, but separate from the counter 118 for counting filament breakages.

Figure 8:
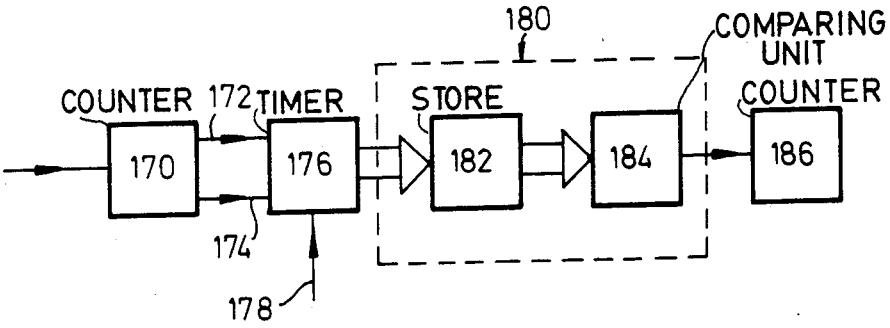
FIG. 8 graphically illustrates a further circuit for processing bursts of logical signals in accordance with the invention.

Referring to FIG. 8, an alternative system for detecting bursts of logic pulses may have all the logic pulses 114, 116, 162 supplied as an input to a counter 170. This counter 170 provides a "time start" signal on an output line 172 as soon as the counter 170 registers the first logic pulse and a "time stop" signal on output line 174 when the nth logic pulse is registered. After counting n logic pulses, the counter 170 automatically resets itself and issues another "time start" signal on output line 172 when the next logic pulse is received and a further time "stop" signal on output line 174 when the nth pulse of the second series is received.

A timer 176 receives clock pulses on an input 178, and is adapted to start counting such pulses upon receiving an input on the line 172 and to stop counting such pulses upon receiving an input on the line 174. The timer 176 therefore provides an indication on its output of the time required for the counter 170 to record successive series each of n logic pulses. In the diagram of FIG. 6, "n" has been assumed to be four logic pulses, although in practice a higher number could be chosen. The time required to receive the first series of four logic pulses is shown at t1, and the time required to receive the second series of four logic pulses t2. The times measured by the timer 176 for successive series of logic pulses are fed to a store and evaluation unit indicated within the dotted lines 180 and comprising a store 182 and a read and compare unit 184. The times measured by the timer 176 are recorded in the store 182 and are compared by the unit 184. When there is a substantial reduction in the time required to accumulate n logic pulses, the unit 184 provides an output pulse incrementing the counter 186 which functions as a "loop burst" counter. The store 182 may be adapted to, hold results of time measurements for a small number of successive series, for example two to five depending upon the time required for evaluation by the read and compare unit 184.

Instead of applying clock pulses to the input 178, it would alternatively be possible to feed pulses related to the angle of rotation of the package and in some cases it may be possible to represent this simply in terms of one pulse per package rotation. Since the principles for time-evaluation and angle-evaluation are essentially the same, it is not believed necessary to deal with this alternative in detail.

Figure 9:
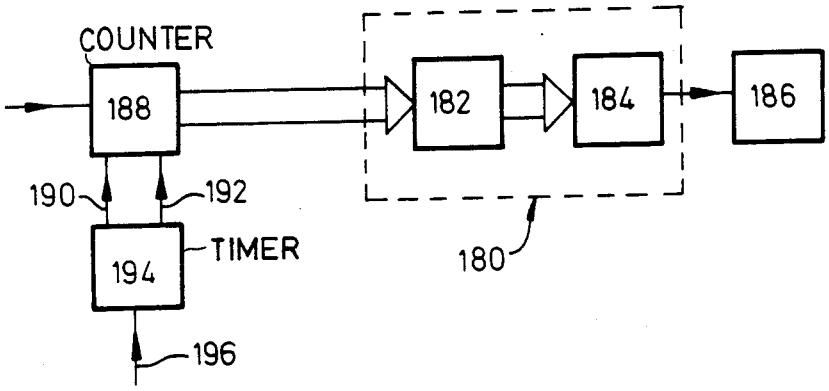
FIG. 9 graphically illustrates a logic circuit similar to that of FIG. 8.

Referring to FIG. 9, the evaluation system may alternatively perform essentially the same function but in a slightly different manner. In this case, the logic pulses are supplied as an input to a counter 188 which is settable by a signal supplied on an input 190 thereto and resettable by a signal supplied on an input 192. These inputs are supplied from a timer 194 which in turn receives clock pulses on an input 196. The timer 194 is adapted to define successive time intervals of constant duration t (FIG. 6). At the start of each interval, the time 194 sets the counter 188 by providing a signal on the input line 190, and at the end of the same interval, the timer 194 resets the counter 188 by providing a signal on the input line 192. The counter 188 counts the number of logic pulses which are received within each of these intervals t, and provides the result as an output to a unit 180 which is essentially the same as the unit 180 in FIG. 8 and which is therefore not believed to require further explanation. Unit 180 again feeds the counter 186 which is also similar to that shown in FIG. 8.

The invention is not limited to details of the illustrated embodiments. Referring, for example, to FIG. 1, the simple monoflop 102 shown there can be replaced by a more complex retriggerable monoflop (also described in the Tietze/Schenk textbook at Page 449). This device can be maintained in an unstable condition provided a new trigger pulse is supplied to its input before a previously triggererd output pulse has been completed. The length of the output pulse produced by each trigger pulse is the same, but the first output pulse can be indefinitely "extended" in response to second and subsequent trigger pulses.

The length of the output pulse in response to any one input trigger pulse (the "basic" output pulse length) is selected to correspond to one or more rotations of the package. The number of rotations represented by a given length of output pulse will vary as the package increases in diameter, assuming constant take-up speed for the thread, and an average must be established for the complete build-up of the package.

Access to the counter is "blocked" by the monoflop as soon as the first contact of a broken thread end with the charge collection has been recorded. Access to the counter remains blocked for each subsequent package rotation in which the same broken thread end contacts the charge collector plus any additional rotations represented by the designed basic ouput pulse length of the monoflop. These additional rotations provide the system with a degree of tolerance regarding occasional non-contact of a still-projecting broken end. When it is overwrapped and can no longer contact the charge collector and trigger the monoflop, then access to the counter for newly broken ends is reinstated at the expiry of the last basic output pulse triggered by the original broken end.

In a modification of the principle described with reference to FIG. 7A, the total number of contacts with the charge collector may be used to operate the Schmidt trigger circuit 168, and the differentiator 166 can be eliminated—the frequency/voltage convertor 164 remaining as before. This arrangement requires, however, that the total number of pulses received by the convertor 164 within a given time period in normal operation is relatively small, so that the output of the convertor 164 is normally inadequate to operate the Schmidt trigger.

Figure 10A:
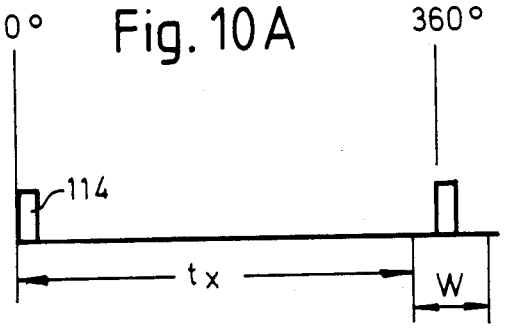
FIG. 10 graphically illustrates a further logic circuit employing a plurality of timers in accordance with the invention and FIG. 10A graphically illustrates a timing sequence of a timer of FIG. 10.
Figure 10:
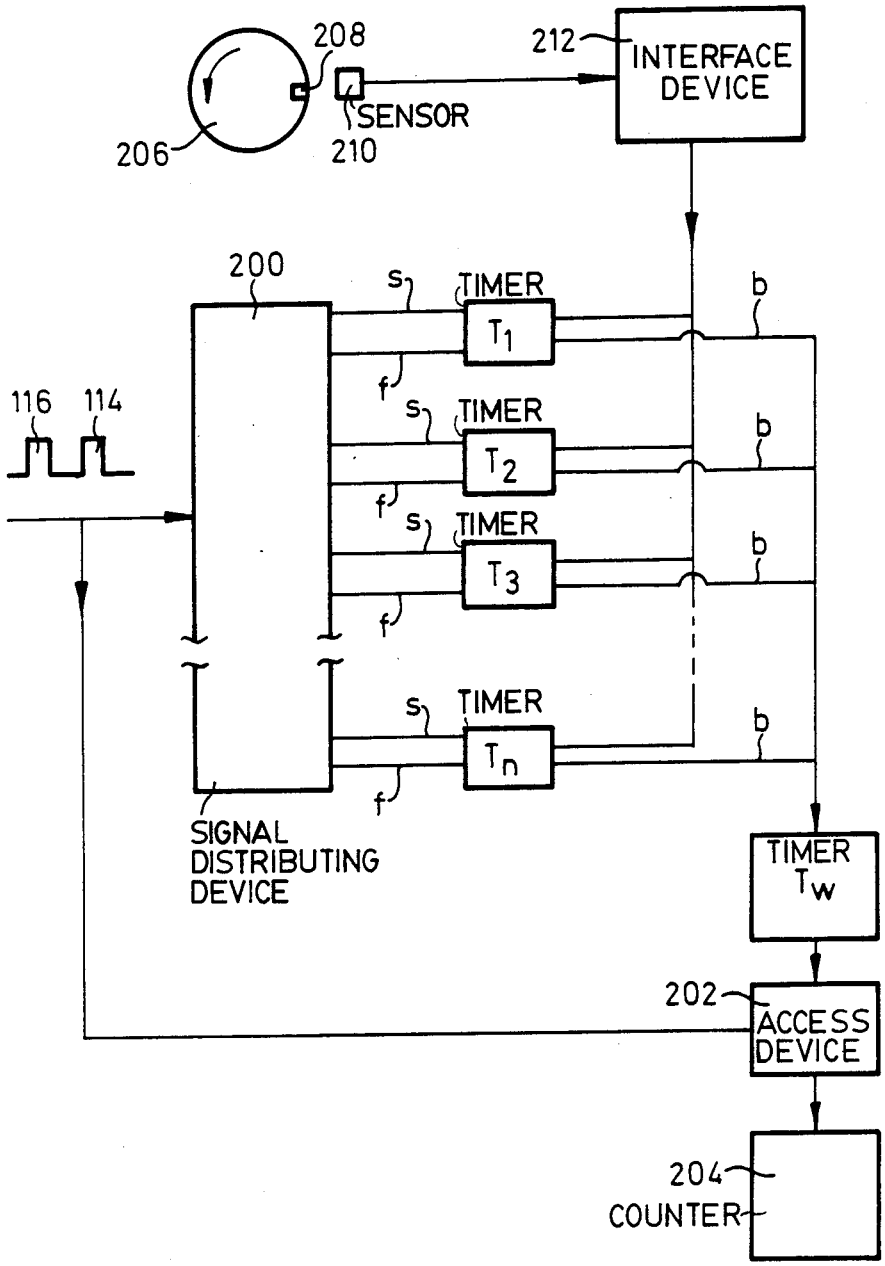

Referring to FIG. 10, the evaluation system may alternatively be constructed with a signal distributing device 200, operation of which will be further described below and a plurality (n) of timers T1, T2, Te---Tn; the number n will also be discussed further below. In addition, the system has a further timer Tw and a unit 202 controlling access to a counter 204.

As indicated, a thread package 206 or a part rotatable therewith during a winding operation, e.g. a chuck on which the package is formed, carries one of a plurality of "markers" 208 which rotate with the package, for example in the direction of the arrow. A sensor 210 is also provided to respond to a marker 208 to produce an output signal each time it is passed by the marker. An interface device 212 which receives the output signals from the sensor 210 provides a corresponding output in a form suitable for input to the timers T1--Tn. The latter are connected to the distributor device 200 for both receiving signals from the distributor 200 on respective lines "s" and sending signals to the distributor 200 on respective lines "f" as will now be described.

The distributor device 200 receives the logic signals 116, 114 previously referred to and these signals are also fed to the counter 204 provided access to the counter 204 is not blocked by the unit 202. The distributor device 200 directs an incoming logic signal to a "free" timer T1--Tn, that is a timer T1--Tn which at the time of arrival of the logic signal is not sending an "occupied" signal to the distributor on its respective line "f". The device 200 can be arranged to "interrogate" the timers T1--Tn in sequence by examining the condition of the lines "f", and to direct an incoming logic signal to the first free timer discovered in a given interrogation sequence.

A logic signal arriving at a free timer initiates a timing operation at the timer, which issues an "occupied" signal on its respective line "f" until the timing operation is completed. The timing operation is itself controlled by the input continuously received by the timer from the interface device 212. The arrangement is such that after it has received an incoming logic signal, the receiving timer defines a time interval tx (FIG. 10A) slightly shorter than the time required for one rotation of the package. For example, if each marker 208 induces a pulse at the output from the sensor 210 and the interface device 212 shapes these pulses for supply to the timers T1---Tn, then the latter can be made as counters, each of which is adapted to count to a preset number after being initiated by a logic signal. The preset number represents the required approximation to a full rotation of the package.

After expiry of its defined interval (reaching its set count), the timer issues a "block" signal on its respective output line "b", and this signal is fed as an input to the timer Tw. The latter defines a short time interval W (FIG. 10A) during which it provides an output signal to the access device 202, thereby blocking access to the counter 204 during the interval W. The previously occupied timer becomes free again and issues a corresponding signal on its line "f".

Consider now the two successive logic pulses 114, 116 The earlier of the 114, is shown again in FIG. 10A. It is assumed to correspond to the first contact of a broken end with the charge collector and no other broken ends have occurred so that all timers T1--Tn are free and timer Tw is not producing an output signal. The access device 202 therefore passes pulse 114 to the counter 204, where a broken end is recorded.

The distributor 200 also passes pulse 114 to one of the timers T1--Tn. The arrival of pulse 114 at the selected timer is arbitrarily indicated as 0° of package rotation in FIG. 10A. The selected timer now defines the interval tx as described above, this time representing just less than 360° of package rotation. At the expiry of interval tx, timer Tw is initiated to cause the device 202 to block access to the counter 204 for interval W such that 360° of package rotation falls within the interval W. Assume that, as shown, the system is such that the second contact of the original broken end with the charge collector occurs at 360° package rotation (this is not essential, but interval W should be chosen so that the second contact will occur within this interval). The second contact with the charge collector produces a logic pulse at the 360° package rotation instant. This pulse is directed by distributor 200 to a free timer selected as before but it cannot be recorded in the counter 204 because access to the counter is already blocked. The operation of the timers is therefore repeated so that each subsequent contact of the same broken end with the charge collector also sets a timer but cannot be recorded.

Assume, however, that pulse 116 represents a second broken end occurring within 360° of package rotation of the first. Timer Tw will therefore not be set at the time of arrival of pulse 116 which is therefore recorded in the counter 205 and initiates its own "sequence" of blocking "windows" by setting a respective timer T1--Tn as determined by distributor 200. A "sequence" of blocking windows is terminated as soon as the respective broken end no longer contacts the charge collector.

The number of timers T1--Tn must be selected so that at least one timer is free when a logic pulse is received. The required number must be established by empirical and statistical methods in dependence upon the operating conditions arising in practice.

The distributor 200 can be constructed in accordance with well known principles of logic circuitry design, for example in accordance with so-called TTL logic or an equivalent logic family. The control unit 202 may be a switching device responsive to e.g. the potential on its input from the timer Tw to open or close the line leading to the counter 204.

The invention thus provides a method of monitoring the quality of a package of thread as represented by the degree of compactness of the thread in the package or the package structure.

Further, the invention provides a technique of monitoring the quality of a package of thread by detecting the number of thread breaks and/or the number of thread loops in a package.

What is claimed is:

1. A method of monitoring the quality of a package of thread during package formation, said method comprising the steps of passing a thread through a predetermined thread path to form a thread package;

sensing a projection of thread beyond said predetermined path at a sensing location maintained at a predetermined spacing from said path at the thread package continuously during forming of the package;

producing an output signal in response to each sensing of a projection of thread at said location;

processing each output signal to produce a corresponding logic signal; and logic processing the logic signals produced during formation of a package of thread to provide an indication of the quality of the package.

2. A method as set forth in claim 1 wherein said logic processing includes the steps of counting sequential series of logic signals while preventing the counting of a logic signal produced during a controllable interval after a preceding logic signal has been counted.

3. A method as set forth in claim 2 wherein said interval is of predetermined duration.

4. A method as set forth in claim 1 wherein said logic processing includes the step of counting each produced logic signal.

5. A method as set forth in claim 1 wherein said logic processing includes the step of recording the stage of rotation of a body of thread at which a logic signal is produced and comparing the record with logic signals received during a succeeding rotation to determine whether a logic signal is received at the same or substantially the same stage of the next rotation.

6. A method as set forth in claim 1 wherein said logic processing includes the step of examining a sequence of logic signals for bursts of relatively high repetition frequency.

7. A method of monitoring a thread package being wound on a bobbin, said method comprising the steps of sensing a projection of thread from the package at a sensing location maintained at a predetermined spacing from the package during winding of the package;

producing an output signal in response to each sensing of a projection of thread at said location;

processing each output signal to produce a corresponding logic signal; and logic processing the logic signals produced to provide an indication of the quality of the wound thread package.

8. A method as set forth in claim 7 wherein said logic processing includes the step of counting the produced logic signals whereby the total number of logic signals indicates the quality of the thread package produced.

9. A method as set forth in claim 8 wherein said logic processing further includes the step of blocking the counting of a logic signal produced during a controllable interval after a preceding logic signal has been counted.

10. A method as set forth in claim 7 wherein said logic processing includes the steps of detecting an angle of rotation of a thread package at which a projection of thread is first sensed while producing an output signal in response thereto and subsequently not producing an output signal in response to the subsequent sensing of a projection of thread at said angle of rotation.

11. A method as set forth in claim 7 wherein said logic processing includes the steps of generating a pulse signal in response to a burst of logic signals consisting of a large number of logic signals in a short period of time as an indication of thread loops occurring in the package.

12. An apparatus for monitoring the quality of a package of thread during package formation comprising means for sensing projection of thread beyond the rotating thread package at a sensing location maintained at a predetermined spacing from the thread package during winding of the thread package and for producing an output signal in response to each sensing of a projection of thread at said location, means for processing each output signal to produce a corresponding logic signal, and logic processing means for processing the logic signals produced during formation of a package to provide an indication of the quality of the package.

* * * * *

UNITED STATES PATENT AND TRADEMARK OFFICE

CERTIFICATE OF CORRECTION

PATENT NO. : 4,713,655

DATED : December 15, 1987

INVENTOR(S) : HANS-JORG SOMMER, et al

It is certified that error appears in the above-identified patent and that said Letters Patent is hereby corrected as shown below:

Column 1, line 13 "package the" should be -package, the-
Column 2, line 45 "logical" should be -logic-
Column 2, line 51 "invention and" shoudl be -invention; and-
Column 3, line 29 "will produced" should be -will be produced-
Column 5, line 37 "the the" should be -the-
Column 7, line 21 "issued" should be -issues-
Column 8, line 17 "corresoond- should be -correspond-
Column 9, line 23 "outout" should be -output-
Column 9, line 30 "64" should be -164-
Column 9, line 67 "pulses" should be -pulses at-
Column 10, line 9 "to, hold" should be -to hold-
Column 12, line 13 "116" should be "116 shown in Fig. 10-
Column 12, line 13 "the 114" should be -these, 114-

Signed and Sealed this

Nineteenth Day of July, 1988

*Attest:*

*Attesting Officer*

DONALD J. QUIGG

*Commissioner of Patents and Trademarks*